US010538825B2

(12) United States Patent
Brunner

(10) Patent No.: US 10,538,825 B2
(45) Date of Patent: Jan. 21, 2020

(54) METHOD FOR THE MANUFACTURE OF A NANOCRYSTALLINE MAGNETIC CORE

(71) Applicant: Vacuumschmelze GmbH & Co. KG, Hanau (DE)

(72) Inventor: Markus Brunner, Bessenbach (DE)

(73) Assignee: VACUUMSCHMELZE GMBH & CO. KG, Hanau (DE)

( * ) Notice: Subject to any disclaimer, the term of this patent is extended or adjusted under 35 U.S.C. 154(b) by 681 days.

(21) Appl. No.: 15/187,447

(22) Filed: Jun. 20, 2016

(65) Prior Publication Data

US 2016/0369364 A1 Dec. 22, 2016

(30) Foreign Application Priority Data

Jun. 22, 2015 (DE) ..... 10 2015 211 487

(51) Int. Cl.
*C21D 9/00* (2006.01)
*C21D 6/00* (2006.01)
(Continued)

(52) U.S. Cl.
CPC ..... *C21D 9/0068* (2013.01); *C21D 6/008* (2013.01); *C22C 38/002* (2013.01); *C22C 38/02* (2013.01);
(Continued)

(58) Field of Classification Search
None
See application file for complete search history.

(56) References Cited

U.S. PATENT DOCUMENTS 4,809,411 A * 3/1989 Lin ..... H01F 41/0226 148/108
5,725,686 A 3/1998 Yoshizawa et al.
(Continued)

FOREIGN PATENT DOCUMENTS

DE 3911480 A1 10/1990
DE 69715575 T2 5/2003
(Continued)

OTHER PUBLICATIONS

ASM Ready Reference: Thermal Properties of Metals, 2002 (Year: 2002).*
(Continued)

*Primary Examiner* — Xiaowei Su
(74) *Attorney, Agent, or Firm* — Dickinson Wright PLLC

(57) ABSTRACT

A magnetic core and method for the manufacture of the magnetic core is presented. The method comprises winding an amorphous tape of a soft magnetic nanocrystallizable alloy possessing a first coefficient of thermal expansion onto a carrier of a material possessing a second coefficient of thermal expansion, wherein the second coefficient is larger than the first coefficient; a first thermal treatment of the wound tape together with the carrier, wherein the first thermal treatment creates a tension in the tape although the alloy remains in an x-ray amorphous state, removing the carrier from the wound tape after cooling of the wound tape together with the carrier; and a second thermal treatment of the wound tape without the carrier, wherein the second thermal treatment provides a nanocrystalline alloy structure, at least 50% of the alloy structure being fine crystalline particles having an average particle size of 100 nanometers or less.

19 Claims, 2 Drawing Sheets

(51) Int. Cl.

| | |
|---|---|
| ***H01F 1/153*** | (2006.01) |
| ***C22C 38/16*** | (2006.01) |
| ***C22C 38/12*** | (2006.01) |
| ***C22C 38/10*** | (2006.01) |
| ***C22C 38/02*** | (2006.01) |
| ***C22C 38/00*** | (2006.01) |

(52) U.S. Cl.
CPC ..... *C22C 38/10* (2013.01); *C22C 38/12* (2013.01); *C22C 38/16* (2013.01); *H01F 1/15333* (2013.01); *H01F 1/15383* (2013.01)

(56) References Cited

U.S. PATENT DOCUMENTS

| | | | | |
|---|---|---|---|---|
| 5,911,840 | A * | 6/1999 | Couderchon | H01F 1/15341 148/121 |
| 2013/0214893 | A1* | 8/2013 | Petzold | C22C 1/02 336/233 |
| 2016/0196907 | A1* | 7/2016 | Ohta | C21D 6/008 148/108 |

FOREIGN PATENT DOCUMENTS

| | | | |
|---|---|---|---|
| DE | 102012109744 | A1 | 4/2014 |
| EP | 0271657 | A2 | 6/1988 |
| EP | 0848397 | A1 | 6/1998 |
| EP | 1320110 | A1 | 6/2003 |

OTHER PUBLICATIONS

Giselher Herzer: Nanocrystalline Soft Magnetic Alloys, Vacuumschmelze GmbH, Handbook of Magnetic Materials, vol. 10, Edited by K.H.J. Buschow, 1997 Elsevier Science B.V.

Hans-Rainer Hilzinger: Stress Induced Magnetic Anisotropy in a Non-Magnetostrictive Amorphouse Alloy, Vacuumschmelze GmbH, Proc. 4th Int. Conf. on Rapidly Quenched Metals (Sendai, 1981).

German Office Action for Application No. 10 2015 211 487.2 dated Dec. 9, 2015.

English Translation of German Office Action for Application No. 10 2015 211 487.2 dated Dec. 9, 2015.

* cited by examiner

METHOD FOR THE MANUFACTURE OF A NANOCRYSTALLINE MAGNETIC CORE

This U.S. patent application claims priority to German patent application no. 10 2015 211 487.2, filed Jun. 22, 2015, the entire content of which is incorporated herein by reference.

TECHNICAL FIELD

The disclosure refers to a method for the manufacture of a highly permeable magnetic core of a soft magnetic alloy, at least 50% of the material volume of which is taken up by fine crystalline particles having a particle size of 100 nanometers or less.

BACKGROUND

The manufacture of nanocrystalline toroidal cores, i.e. of soft-magnetic toroidal cores, at least 50% of the material volume of which is taken up by fine crystalline particles having a particle size of 100 nanometers or less, is generally difficult and costly because the magnetic material, for example, must be nearly free of magnetostriction after thermal treatment and, in addition to this, virtually no mechanical tension must be allowed to effect the magnetic material during thermal treatment. It is therefore desirable to provide a method for manufacturing magnetic cores that is less sensitive and easer to carry out, in order to thus achieve a more easily manufactured magnetic core.

SUMMARY

A method for the manufacture of a magnetic core is presented which comprises the following steps: Winding an amorphous tape made of a soft-magnetic nano-crystalline alloy having a first thermal expansion coefficient onto a carrier made of a material having a second thermal expansion coefficient, wherein the second thermal expansion coefficient is larger than the first thermal expansion coefficient. A first thermal treatment of the wound tape and the carrier, wherein the tape while the alloy maintains an x-ray amorphous state. Removal of the carrier from the wound tape after cooling of the wound tape and the carrier. A second thermal treatment of the wound tape without the carrier, wherein the second thermal treatment is configured such that the amorphous alloy structure is transformed into a nanocrystalline alloy structure, at least 50% of the alloy structure of which is taken up by fine crystalline particles having an average particle size of 100 nanometers or less.

DETAILED DESCRIPTION OF EXAMPLE EMBODIMENTS

Figure 1:
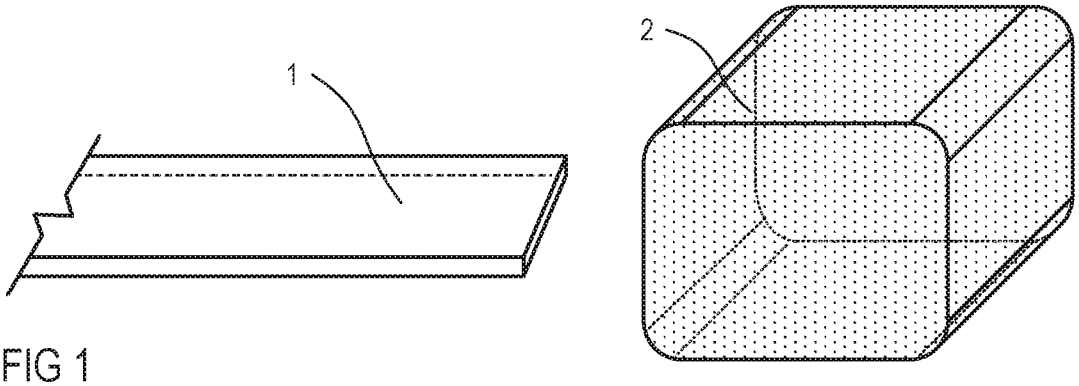
FIG. 1 shows an amorphous tape made of a soft magnetic, nanocrystalline alloy for the manufacture of a magnetic toroidal core and a carrier, on which the tape is to be wound.
Figure 2:
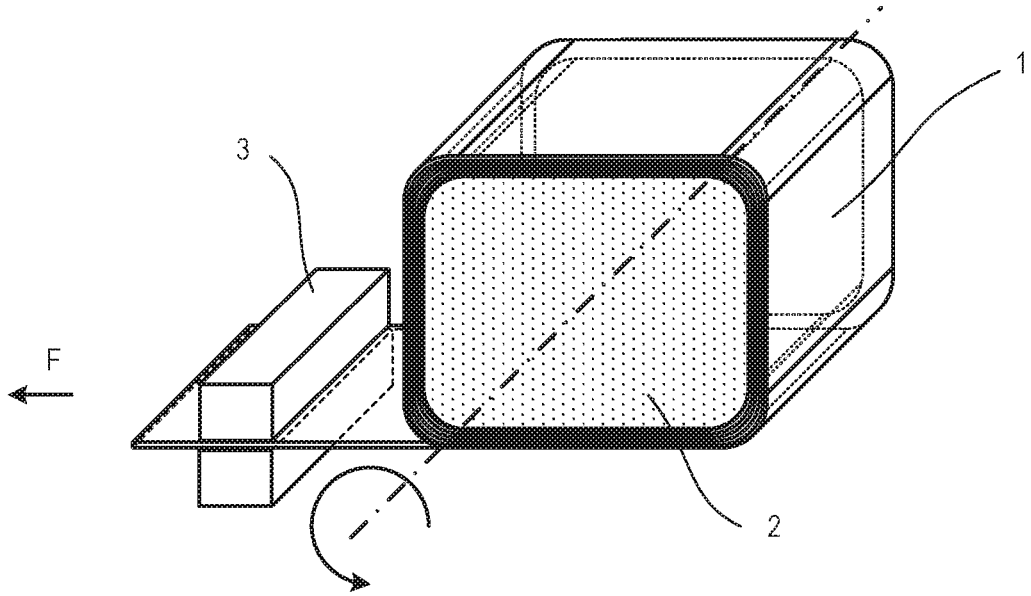
FIG. 2 shows the tape being wound around the carrier under tension.
Figure 3:
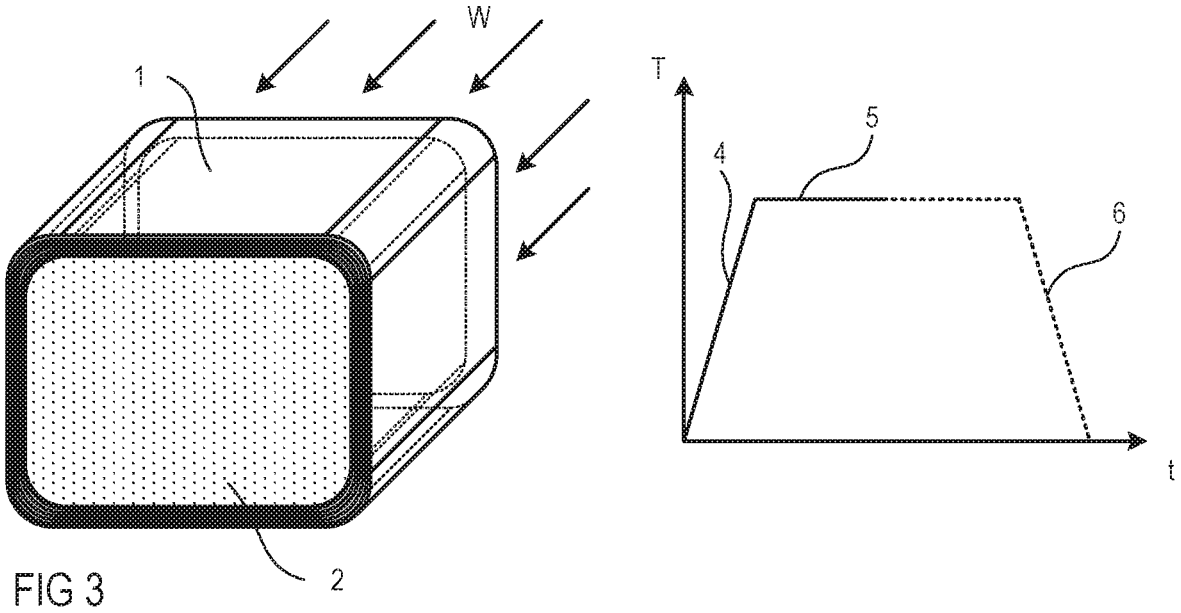
FIG. 3 shows a first thermal treatment applied both to the wound tape and the carrier.
Figure 4:
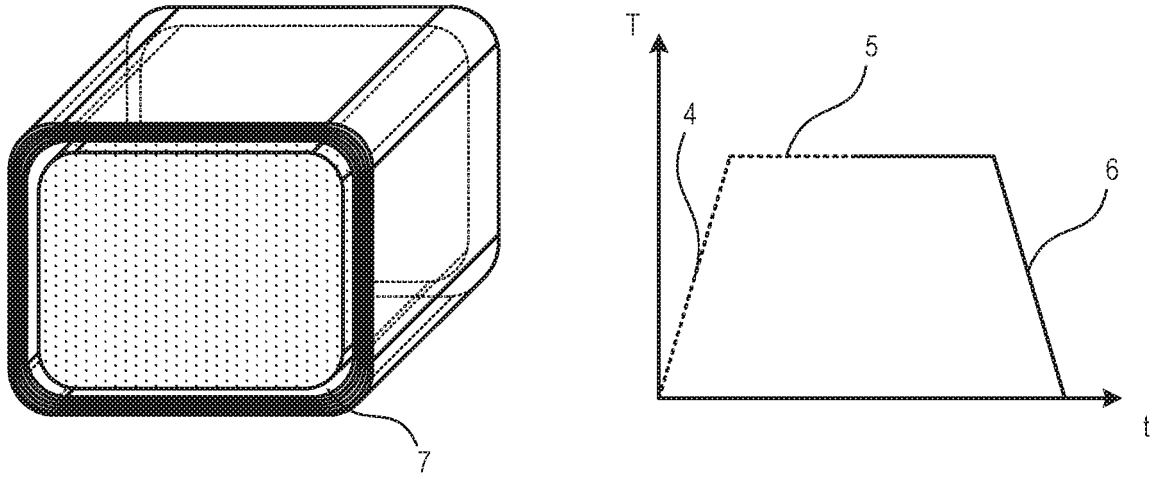
FIG. 4 shows wound tape and carrier after cooling at the end of the first thermal treatment and with the formation of a gap between the wound tape and the carrier.

The method described below serves to manufacture toroidal, rectangular, square, elliptical or otherwise formed tape wound cores by winding a tape onto a reel or a supporting body having the corresponding form of producible geometrics and allows the manufacture of wound cores (magnetic cores wound of tape) with very well defined geometric contours with regard to the employed carrier and having very high filling factors. The term filling factor refers in this case to the proportion of the volume of magnetic material to the enclosing volume of the geometric body that forms the magnetic core. These correlations are described in detail on page 111 of the book "Magnetic Materials" from R. Hilzinger and W. Rodewald, ISBN 978-3-89578-352-4.

Common alloys for the manufacture of such toroidal tape wound cores are described, for example, in G. Herzer's article, "Nanocrystalline Soft Magnetic Alloys", published in the Handbook of magnetic Materials Vol. 10 from Elsevier publishers, 1997, pages 415 to 461.

With the correct choice of alloy composition and of the thermal treatment for adjusting the nanocrystalline microstructure, nanocrystalline alloys from this family can be used to manufacture magnetic cores with a highly linear hysteresis loop (also known as F loop) and having permeabilities of far over 10,000, as well as, alternatively, magnetic cores with a round hysteresis loop and having permeabilities of far over 100,000 or magnetic cores with a rectangular hysteresis loop and permeabilities greater than 500,000. For this it is considered to be a prerequisite that the magnetic material be nearly magnetostriction free after thermal treatment and that, during the thermal treatment, virtually no mechanical tensions are applied to the magnetic material as these would lead to the formation of a stress-induced anisotropy in the material which in turn would inevitably result in a comparably low permeability and, partially, to non-linear hysteresis loops. Whether these mechanical tensions are introduced during the thermal treatment, when the material is still in an amorphous state, during the nano-crystallization or only after the material has crystallized, should be of no importance.

If these soft magnetic alloys are exposed to targeted mechanical tensions during the thermal treatment to nanocrystallization, the magnetic cores will have low to very low permeabilities depending on the degree of tension applied. This is described in detail in the article "Magnetic properties of nanocrystalline Fe—CuNbSiB with huge creep induced anisotropy" by G. Herzer et al., published at the $2^{nd}$ Int. Symposium on Advanced Magnetic Materials and Applications, 2010. For this reason, when these alloys are used to manufacture highly permeable magnetic cores one generally tries to ensure that the magnetic material is not exposed to any mechanical forces during the thermal treatment. To ensure this, the magnetic cores are, for example, either individually placed on a suitable surface before being thermally treated, or they are stacked on support poles in the form of so-called core stacks, wherein the diameter of the support construction is always significantly smaller than the inner diameter of the magnetic core that is annealed on it. It should also be taken into account that, during the nanocrystallization of these alloys, an increase of their material density of app. 3.5% occurs, which naturally leads to a corresponding reduction in the volume of the magnetic core and, consequently, also of its inner diameter. It is therefore standard practice to select support constructions for torus-shaped magnetic cores that have a diameter that is between 50 and 80% of the magnetic core's inner diameter.

This, in turn, requires the manufacture of magnetic cores made of rapidly hardening tape that are self-supporting after winding and inherently stable without additional inner support, meaning, in the case of a tape wound core, for example, that it maintains its torus shape. Because of the geometric errors that are intrinsic to these tape materials, the aforementioned requirements place high demands on the winding technology used, especially in the case, for example, of tape wound cores of larger diameters (around 100 mm and more) and the resulting decreased inherent stability of their toroidal form. In these, even the slightest amount of tension in the area of the outer tape layers can cause the torus shape to collapse and produce a dent in the tape core. The cause of this tension is the torque that increases progressively as the winding diameter be-comes larger while the winding tension remains the same, leading in turn to a normal force being directed toward the center point of the wound tape. In order to minimize this effect, during core winding the winding tension is generally adapted to the increasing diameter, i.e. it is reduced.

Since, however, is it generally neither possible to adjust winding tension controllers with sufficient precision, nor to compensate the unforeseeable tension patterns that geometric errors in the tapes cause in the wound cores, cores with larger inner diameters (of about 100 mm or more) must be wound using a comparatively very low winding tension equal to or less than 1N per 10 mm tape width. This low winding tension results in a very loosely wound core with filling factors that are significantly lower than those found in cores wound with the same tape under higher winding tension, such as smaller tape wound cores (e.g. with an inner diameter of less than 20 mm), which are, to a great extent, inherently stabile. The loss of component density (filling factor) generally amounts here to about 5%, in individual cases to as much as 10%. This is a disadvantage in cases, for example, in which only limited installation space is available for fulfillment of the desired magnetic function, as the loosely wound core, while having the same mass, will naturally have considerably more volume than a more tightly wound one.

When manufacturing cores with non-round shapes it is practically impossible to produce tension-free inherently stable wound cores with small mechanical tolerances, as the form of the winding changes in an unforeseeable manner after removing the carrier and generally has little resemblance to the originally desired geometric form. For this reason, when manufacturing cores with non-round shapes they are sometimes thermally treated while in a torus form, after which they are given their final form, e.g. as a rectangle, and stabilized with an adhesive impregnation. As an alternative, the carrier can first be lined with a material that quickly disintegrates under the influence of the thermal treatment, leaving the core wound on the carrier to a great extent tension-free. For this wound layers of special paper types are commonly used, on top of which the soft magnetic tape is then wound.

Both methods allow for a thermal treatment of non-round forms that is largely tension-free, the contours of cores manufactured in this manner, however, still suffer considerable deficiencies. It is virtually impossible to limit the deviations in the contours from the employed carrier to less than 2 mm because, even in this case, cores wound to a round shape that are intended to be given a non-round shape after winding can collapse when the carrier is removed if the tape tension is too high. In such instances, the non-round core shapes collapse after the inner paper layers are burnt off during thermal treatment, erratically forming wrinkles in the layers of wound tape which are then tempered into a permanent state during the thermal treatment.

It is, however, desirable to manufacture tape wound cores that have high filling factors, which requires high winding tension, while at the same time being able to freely determine the geometric form of the wound core within the smallest possible tolerances and while achieving either very high permeabilities, very linear magnetization curves or both.

Contrary to the statements made in the above cited article from G. Herzer and contrary, as well, to the teachings of R. Hilzinger's article "Stress Induced Magnetic Anisotropy In A Nonmagnetostrictive Amorphous Alloy", published during the $4^{th}$ Int. Conf. On Rapidly Quenched Metals, Sendai, 1981, it has been found is, indeed, possible to carry out a thermal treatment while applying tension to the magnetic tape in order to give it a certain form without having to sacrifice the high and very high permeabilities that, according to the mentioned articles, are not possible to achieve when applying thermal treatment under tension.

Contrary to the prevailing opinion, it was found that a first thermal treatment, for example at temperatures of between 300° C. and 460° C. for a duration of between 0.1 and 12 hours and under tensions of more than 25 MPa, is sufficient to allow for a further thermal treatment of tape wound cores made of alloys from this family that stabilizes any core geometry that can be made by winding tape on a corresponding supporting body. The tape wound on the carrier is slightly plastically deformed by this thermal treatment and conforms exactly to the contour of the carrier. After cooling, following the first thermal treatment, the carrier is removed and the desired nanocrystalline structure is formed during a second thermal treatment, wherein the desired form of the hysteresis loop and the permeability are adjusted, if needed, by applying an outer magnetic field.

For example, the manufacture of a desired magnetic core may be carried out by winding a rapidly solidified amorphous alloy tape of nanocrystallizable composition on a metal carrier with sufficient mechanical stability whose coefficient of thermal expansion is approximately 2 ppm to 80 ppm, for example 3 ppm-50 ppm or 3 ppm-12 ppm, larger than the coefficient of thermal expansion of the soft magnetic alloy that is to be utilized. In this case the winding tension of the soft magnetic tape can be increased at will to its breakage point, as the carrier that remains inside of the wound core makes a deformation of the wound tape impossible.

The winding process is followed by a first thermal treatment under a reducing or neutral protective gas at a temperature that is high enough to produce, through the differing thermal expansion of the materials, a tension of the wound tape that lies as high as 25 MPa or higher. This tension, in combination with the elevated temperature during the first thermal treatment, induces a plastic flow of the magnetic material, causing the wound core to conform perfectly to the contour of the carrier. This is accompanied by an almost complete reduction of the tension introduced into the tape. After the prescribed duration of thermal treatment is completed, the core is cooled to room temperature. In the process, the metal carrier, due to its higher coefficient of thermal expansion, contracts to a greater extent than the core wound on it and a small gap forms between the carrier and the magnetic core, allowing the carrier to be easily removed from the core.

As all tensions introduced into the wound core by the tape tension during winding or caused by intrinsic geometric errors of the tape are relaxed by the plastic flow of the tape during the described thermal treatment, the magnetic core is now free of residual tensions and dimensionally stable. It is important that the magnetic material remains in an x-ray amorphous state after this first thermal treatment and that the formation of a nanocrystalline structure has not yet begun. Therefore, both the duration of this first thermal treatment and the temperature at which it is carried out must be adapted to the specific characteristics of each alloy composition.

After the carrier is removed, a second thermal treatment may be carried out, for example at maximum temperatures of between 520° C. and 600° C., for a duration of between 0.5 and 8 hours and, for example, under a protective gas of high-purity hydrogen. With the second thermal treatment the desired nanocrystalline phase with a volume fraction of greater than 50% is adjusted. While undergoing the second thermal treatment the magnetic core is free of mechanical tension during the formation of its nanocrystalline structure, which prevents the formation of a tension-induced orientation of the FeSi-crystallites. The anisotropy induced by the tension during the first thermal treatment is fully eliminated during the nano-crystallization and the accompanying complete change of structure so that it is no longer detectable after completion of the second thermal treatment for nanocrystallization. The second thermal treatment may optionally be carried out with the aid of an outer magnetic field to achieve a specifically uniaxial anisotropy and thus to selectively adjust a specific form of the hysteresis loop and/or the permeability.

1. First Specific Example:

A tape of nanocrystallizable magnetic alloy having the nominal composition FeCo0,5Cu0,98Nb2,28Si15,7B7,1 (in atomic percentages) and a tape width of 25 mm is first superficially coated with a magnesium hydroxide coating of less than 1 μm thickness in a run-through process. After this the tape is wound onto a section of pipe having an outer diameter of 150 mm, a width of 25 mm, as well, and a material thickness of 6 mm to form a magnetic core having the dimensions of 190 mm×150 mm×25 mm. An unalloyed construction steel with the material number 1.0122 is used for the section of pipe. In a temperature range of up to approximately 400° C., this steel demonstrates a coefficient of thermal expansion of 12.5 ppm-13 ppm, the alloy tape of the composition described above has a coefficient of thermal expansion of 8 ppm. During the winding of the tape core the total tape tension is set at 7 N, that is 2.8N/10 mm. Under these winding conditions and using this tape material, a filling factor of 83.7% is achieved.

After the wound core is finished it is thermally treated for the first time for 2 hours under hydrogen at a temperature of 400° C. The differences in thermal expansion at this temperature create tape tensions of approximately 150 MPa-250 MPa. After the first thermal treatment and after cooling to room temperature, a circumferential gap of app. 0.1 mm has formed between the carrier and the tape wound core, allowing the carrier to be easily removed from the core. Following this a second thermal treatment lasting one hour with a temperature plateau of 565° C. and under pure hydrogen is carried out. The magnetic core manufactured in this way possesses a round hysteresis loop and a maximum permeability of 575000 at 50 Hz. The soft magnetic nanocrystallizable alloy is an iron-based alloy whose chemical composition in atomic percentages is Fe≥50%, 0.1%≤Cu≤3%, 0%≤B≤25%, 0%≤Si≤30% and includes at least one element chosen from the group Nb, W, Ta, Zr, Hf, Ti and Mo with contents of between 0.1% and 30% and wherein the remaining content consists of impurities resulting from its production and the composition fulfills the relationship 5%≤Si+B≤30%. The soft magnetic nanocrystallizable alloy is an alloy having a chemical composition with the general formula $(Fe_{100-a}M_a)_{100-x-y-z-\alpha}\,Cu_xSi_yB_zM'_\alpha$, wherein in atomic percentages M is equal to Co or Ni, M' is at least one element from a group of Nb, W, Ta, Zr, Hf, Ti and Mo and a, x, y, z and α each correspond to the equation 0.0%≤a≤0.5%, 0.1%≤x≤3.0%, 0%≤y≤30.0%, 0%≤z≤25.0%, 5.0%≤y+z≤30.0% and 0.1%≤α≤30.0%. The soft magnetic nanocrystallizable alloy is an alloy comprising in atomic percentages $Fe_{100-a-b-c-d-x-y-z}$, $CU_a$, $Nb_b$, $M_c$, $T_d$, $Si_x$, $B_y$, $Z_z$ and containing up to 1% impurities, wherein M is Mo or Ta, T comprise one or several of the elements V, Cr, Co and Ni and Z comprises one or more of the elements C, P and Ge and 0.0%≤a<1.5%, 0.0%≤b<3.0%, 0.2%≤c≤4.0%, 0.0%≤d<5.0%, 12.0%<x<18.0%, 5.0%<y<12.0% and 0.0%≤z<2.0% and 2.0%≤(b+c)≤4.0%. The soft magnetic nanocrystallizable alloy is an alloy comprising in atomic percentages $Fe_aCo_bNi_cCu_dM_eSi_fB_gX_h$ and up to 1% impurities, wherein M is at least one of the elements V, Nb, Ta, Ti, Mo, W, Zr, Cr, Mn and Hf and X comprises the elements P, Ge and C and 0≤b≤40; 2<c<20; 0.5≤d≤2; 1≤e≤6; 6.5≤f≤18; 5≤g≤14; h<5 and 5≤b+c≤45 and a+b+c+d+e+f=100.

2. Second Specific Example:

As in the case of the first specific example, a tape wound core was wound using the same tape material with the same parameters, the core having a filling factor of 83.2%. The tape wound core was first annealed in the same way, in a two-step thermal treatment, wherein in this case, following the temperature plateau of 565°, an additional temperature plateau at 390° C. was maintained for the duration of four hours. During this period, a magnetic field is applied perpendicular to the winding direction of the magnetic core by a field coil positioned around the outside of the oven. After cooling to room temperature this magnetic core had a flat hysteresis loop and a permeability of 68000 at 50 Hz.

3. Third Specific Example (for comparison):

As in the case of the first specific example, tape wound core was wound using the same tape material with the same parameters, the core having a filling factor of 83.5%. The magnetic core manufactured in this way was immediately subject to the thermal treatment at 565° C. for nanocrystallization, without undergoing the preceding thermal treatment at 400° C. The carrier remained in the magnetic core during this thermal treatment. After the thermal treatment, the magnetic core had contracted to firmly encompass the carrier, which could only then be removed from the magnetic core by mechanically destroying the carrier. A subsequent measuring of the magnetic characteristics revealed a maximum permeability of 3500 at 50 Hz and a hysteresis loop that was strongly non-linear.

4. Fourth Specific Example (for Comparison):

In a further specific example, a tape wound core was manufactured using the same tape material with the same winding parameters as in the first specific example, the core having a filling factor of up to 82.7%. After winding the carrier was pressed out of the core. A large indentation formed on the inner side of the core diameter immediately after removing the carrier and it was impossible to reestablish its circular form.

5. Fifth Specific Example (for Comparison):

In a further specific example, a toroidal core is manufactured using the same tape material as in the first specific example, wherein the tape tension is limited to 2N. After winding the core achieved a filling factor of 76.1%. The carrier could be removed from the wound core without its geometric form being altered. The magnetic core manufactured in this way was immediately subject to the (second) thermal treatment at 565° C. for nano-crystallization without undergoing the (first) thermal treatment at 400° C. Subsequently, a maximum permeability of this magnetic core of 545000 at 50 Hz was measured.

6. Sixth Specific Example

In a further specific example a rectangular core was formed using the same tape material as in the first specific example by winding the tape onto a cuboid of the dimensions 100 mm×60 mm×25 mm with an edge radius of 2 mm. The winding tension of the tape was 8N and the filling factor of the magnetic core, which had the dimensions of 150 mm×110 mm×25 mm, was 82.6%. The winding was followed by the two-step thermal treatment at 400° C. and 565° C., as described above. After the thermal treatment a permeability of 495,000 at 50 Hz was measured on this magnetic core. The mechanical dimensions of the carrier were reproduced very well in the magnetic core and the average dimensional deviations of the magnetic core from the carrier used for its manufacture were less than 0.8 mm.

An example method for the manufacture of a magnetic core is also shown in the FIGS. 1 to 6. As shown in FIG. 1, first an amorphous tape 1 and a carrier 2 are provided. The amorphous tape 1 may be manufactured, for example, from a molten iron-based alloy using rapid solidification technology. The carrier 2 is made, for example, of solid metal and has a coefficient of thermal expansion that is higher than the coefficient of thermal expansion of the tape 1. An amorphous tape 1 is then wound onto the carrier 2, for example, by means of a tensioning device 3 and employing a traction F. After winding is completed, the wound tape 1 undergoes, together with the carrier 2, a first thermal treatment (see FIG. 3), which is configured such that tension is introduced into the tape 1, whereas the tape alloy nevertheless maintains an x-ray amorphous state. The temperature profile may, for example, be configured such that by supplying or discharging heat W, the temperature T can be raised over time t to a plateau (warming phase 4), maintained at this plateau for a certain period (plateau phase 5) and then lowered again (cooling phase 6), wherein with the same procedure numerous warming, plateau and cooling phases at different temperatures and for different durations are possible during the first thermal treatment. Because of the greater coefficient of thermal expansion of the carrier in comparison to the coefficient of thermal expansion of the tape 1, the latter adheres firmly to the carrier during the first thermal treatment and tension is introduced into the wound tape 1.

Figure 5:
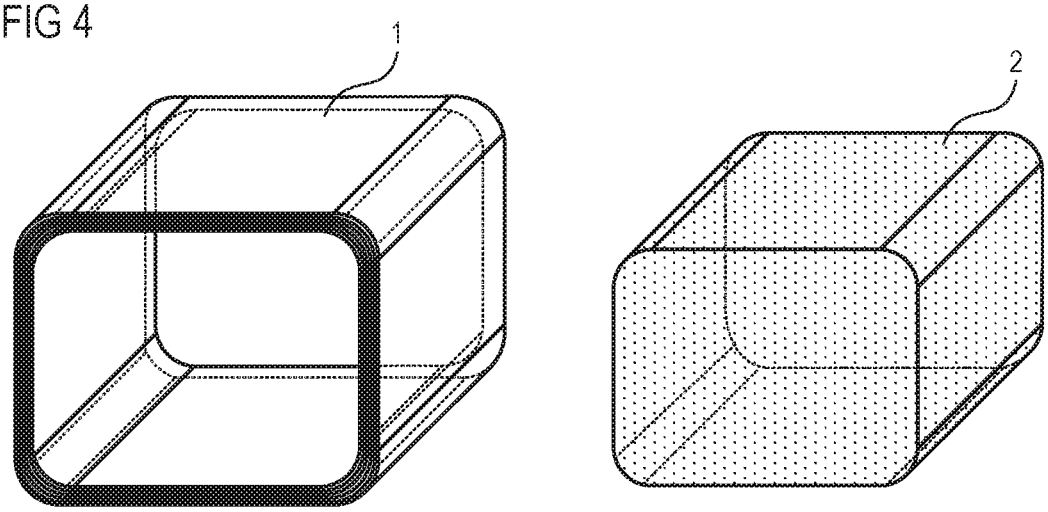
FIG. 5 shows wound tape and carrier after the completed removal of the carrier subsequent to the cooling.
Figure 6:
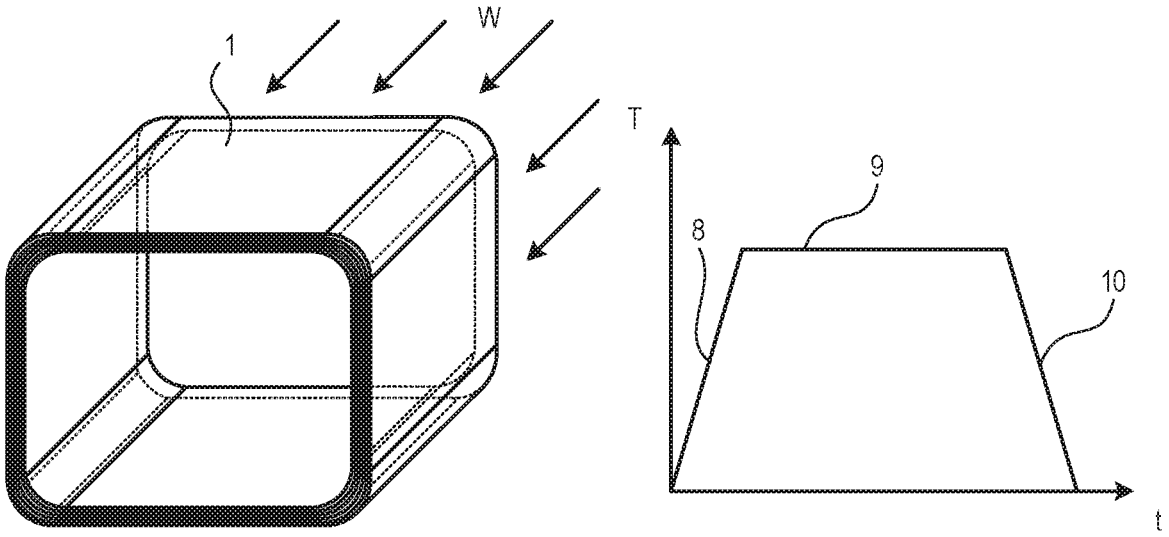
FIG. 6 shows the wound tape with the carrier during the second thermal treatment.

Due to their differing coefficients of thermal expansion, the wound tape 1 and the carrier 2 now exhibit divergent behavior during cooling and a gap 7 forms between tape 1 and carrier 2 (see FIG. 4), thus enabling the carrier 2 to be easily removed from the wound tape 1 after cooling (see FIG. 5). As can be seen from FIG. 6, the wound tape 1 is then subject to a second thermal treatment without the carrier 2, wherein the second thermal treatment is configured such that the amorphous structure of the alloy is transformed into a nanocrystalline structure, of which at least 50% is taken up by fine crystalline particles possessing an average particle size of 100 nanometers or less. This results in a magnetic core with a high filling factor. The temperature profile may, for example, be configured such that by supplying or discharging heat W, the temperature T can be raised over time t to a plateau (warming phase 8), maintained at this plateau for a certain period (plateau phase 9) and then lowered again (cooling phase 10), wherein with the same procedure numerous warming, plateau and cooling phases at different temperatures and for different durations are possible during the second thermal treatment.

The description of embodiments has been presented for purposes of illustration and description. Suitable modifications and variations to the embodiments may be performed in light of the above description. The described assemblies, systems and methods are exemplary in nature, and may include additional elements or steps and/or omit elements or steps. As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects.

The invention claimed is:

1. A method for the manufacture of a magnetic core comprising the steps of:

first, winding an amorphous tape of a soft magnetic nanocrystallizable alloy possessing a first coefficient of thermal expansion onto a carrier made of a material possessing a second coefficient of thermal expansion, wherein the second coefficient of thermal expansion is larger than the first coefficient of thermal expansion;

second, subjecting the wound tape and carrier to a first thermal treatment, wherein the first thermal treatment is configured such that it causes tension to be introduced into the tape by thermal expansion of the carrier, although the alloy remains in an amorphous state, and then removing the carrier from the wound tape after cooling of the wound tape and the carrier; and third, following the cooling a second thermal treatment of the wound tape without the carrier, wherein the second thermal treatment is configured such that the amorphous alloy structure is transformed into a nanocrystalline alloy structure with at least 50% of the alloy structure being formed of fine crystalline particles having an average particle size of 100 nanometers or less.

2. The method of claim 1, in which the soft magnetic nanocrystallizable alloy is an iron-based alloy whose chemical composition in atomic percentages is Fe≥50%, 0.1%≤Cu≤3%, 0%≤B≤25%, 0%≤Si≤30% and includes at least one element selected from the group consisting of Nb, W, Ta, Zr, Hf, Ti and Mo with contents of between 0.1% and 30% and wherein the remaining content consists of impurities resulting from its production and the composition fulfills the relationship 5%≤Si+B≤30%.

3. The method of claim 1, in which the soft magnetic nanocrystallizable alloy is an alloy having a chemical composition with the general formula $(Fe_{100-a}M_a)_{100-x-y-z-\alpha}Cu_xSi_yB_zM'_\alpha$, wherein in atomic percentages M is equal to Co or Ni, M' is at least one element selected from the group consisting of Nb, W, Ta, Zr, Hf, Ti and Mo and a, x, y, z and α each correspond to the equation 0.0%≤a≤0.5%, 0.1%≤x≤3.0%, 0%≤y≤30.0%, 0%≤z≤25.0%, 5.0%≤y+z≤30.0% and 0.1%≤α≤30.0%.

4. The method of claim 1, in which the soft magnetic nanocrystallizable alloy is an alloy comprising in atomic percentages $Fe_{100-a-b-c-d-x-y-z}$, $Cu_a$, $Nb_b$, $M_c$, $T_d$, $Si_x$, $B_y$, $Z_z$ and containing up to 1% impurities, wherein M is Mo or Ta, T is one or several of the elements selected from the group consisting of V, Cr, Co and Ni and Z is one or more of the elements selected from the group consisting of C, P and Ge and $0.0\% \leq a < 1.5\%$, $0.0\% \leq b < 3.0\%$, $0.2\% \leq c \leq 4.0\%$, $0.0\% \leq d < 5.0\%$, $12.0\% < x < 18.0\%$, $5.0\% < y < 12.0\%$ and $0.0\% \leq z < 2.0\%$ and $2.0\% \leq (b+c) \leq 4.0\%$.

5. The method of claim 1, in which the soft magnetic nanocrystallizable alloy is an alloy comprising in atomic percentages $Fe_aCo_bNi_cCu_dM_eSi_fB_gX_h$ and up to 1% impurities, wherein M is at least one of the elements selected from the group consisting of V, Nb, Ta, Ti, Mo, W, Zr, Cr, Mn and Hf and X is at least one element selected from the group consisting of P, Ge and C and $0 \leq b \leq 40$; $2 < c < 20$; $0.5 \leq d \leq 2$; $1 \leq e \leq 6$; $6.5 \leq f \leq 18$; $5 \leq g \leq 14$; $h < 5$ and $5 \leq b+c \leq 45$ and $a+b+c+d+e+f=100$.

6. The method of claim 1 further comprising: providing the amorphous tape from a molten iron-based alloy using rapid solidification technology.

7. The method according of claim 1, in which the second coefficient of thermal expansion is 2 to 80 ppm higher than the first coefficient of thermal expansion.

8. The method of claim 7, in which the second coefficient of thermal expansion is 3 to 50 ppm higher than the first coefficient of thermal expansion.

9. The method of claim 8, in which the second coefficient of thermal expansion is 3 to 12 ppm higher than the first coefficient of thermal expansion.

10. The method of claim 1, in which the core has a circular, elliptic or polygonal outline.

11. The method of claim 1, in which the amorphous tape is subject to tension of more than 25 MPa during the first thermal treatment.

12. The method of claim 11, in which the amorphous tape is subject to tension of up to 300 MPa during the first thermal treatment.

13. The method of claim 1, in which the amorphous tape is subject to maximum temperatures of between 300° C. and 460° C. during the first thermal treatment.

14. The method of claim 1, in which the first thermal treatment lasts between 0.1 hours and 12 hours.

15. The method of claim 1, in which the amorphous tape is subject to maximum temperatures of between 520° C. and 600° C. during the second thermal treatment.

16. The method of claim 1, in which the second thermal treatment lasts between 0.5 and 8 hours.

17. The method of claim 1, in which the first thermal treatment or the second thermal treatment or both thermal treatments is (are) carried out under a protective gas.

18. The method of claim 17, in which pure hydrogen is used as the protective gas.

19. The method of claim 1, in which the second thermal treatment is carried out under the influence of an applied external magnetic field.

* * * * *